US006434904B1

(12) United States Patent
Gutschmidt et al.

(10) Patent No.: US 6,434,904 B1
(45) Date of Patent: Aug. 20, 2002

(54) SEALING DEVICE

(75) Inventors: Holger Gutschmidt, Neu Wulmstorf; Dieter Kassel, Rönnenberg, both of (DE)

(73) Assignee: Phoenix Aktiengesellschaft, Hamburg (DE)

( * ) Notice: Subject to any disclaimer, the term of this patent is extended or adjusted under 35 U.S.C. 154(b) by 0 days.

(21) Appl. No.: 09/701,764

(22) PCT Filed: Jun. 24, 1999

(86) PCT No.: PCT/DE99/02132

§ 371 (c)(1),
(2), (4) Date: Dec. 1, 2000

(87) PCT Pub. No.: WO00/03121

PCT Pub. Date: Jan. 20, 2000

(30) Foreign Application Priority Data

Jul. 8, 1998 (DE) ..... 198 30 376

(51) Int. Cl.[7] ..... E04B 1/68

(52) U.S. Cl. ..... 52/393; 52/396.03; 52/396.02; 52/396.04; 52/396.08; 52/396.09

(58) Field of Search ..... 52/393, 396.02, 52/396.03, 396.04, 396.06, 396.08, 396.09; 405/152, 151; 277/626; 404/74

(56) References Cited

U.S. PATENT DOCUMENTS

| | | | | | |
|---|---|---|---|---|---|
| 1,723,306 | A | * | 8/1929 | Sipe | 52/396.03 |
| 2,798,373 | A | * | 7/1957 | Harza | 52/396.04 |
| 2,937,065 | A | * | 5/1960 | Harza | 52/396.04 |
| 3,107,377 | A | * | 10/1963 | Nathan | 52/396.03 |
| 3,205,629 | A | * | 9/1965 | Rumley et al. | 52/393 |
| 3,391,510 | A | * | 7/1968 | Harbert | 52/393 |
| 3,598,026 | A | * | 8/1971 | Johnson | 277/205 |
| 3,671,346 | A | | 6/1972 | Tsuzuki | |
| 3,682,053 | A | * | 8/1972 | Kerschner | 94/18 |
| 4,126,977 | A | * | 11/1978 | Chisum | 52/233 |
| 4,199,158 | A | * | 4/1980 | deMunck | 277/205 |
| 4,325,414 | A | | 4/1982 | Schaefer | |
| 4,727,695 | A | * | 3/1988 | Kemeny | 52/167 |
| 4,762,441 | A | * | 8/1988 | Glang | 405/152 |
| 4,824,289 | A | * | 4/1989 | Glang et al. | 405/152 |
| 4,900,607 | A | * | 2/1990 | Glang et al. | 428/131 |
| 4,946,309 | A | | 8/1990 | Glang | |
| 5,074,711 | A | * | 12/1991 | Glang et al. | 405/152 |
| 5,575,126 | A | * | 11/1996 | Attaway et al. | 52/396.02 |
| 6,129,485 | A | * | 10/2000 | Grabe et al. | 405/152 |

FOREIGN PATENT DOCUMENTS

| | | | | |
|---|---|---|---|---|
| DE | 1 708 690 | | 6/1971 | |
| DE | 24 41 118 | | 3/1976 | |
| DE | 3606370 | * | 9/1987 | 52/396.02 |
| FR | 2 712 655 | | 5/1995 | |

* cited by examiner

*Primary Examiner*—Lanna Mai
*Assistant Examiner*—Phi Dieu Tran A
(74) *Attorney, Agent, or Firm*—Collard & Roe, P.C.

(57) ABSTRACT

The invention relates to a sealing device consisting of two contiguous building elements made of concrete, steel, reinforced concrete, cast iron or other materials, and a shaped sealing element made of an elastomer material which is inserted into a recess and bridges the gap between the building elements in a sealing manner. The building elements are in particular segments which are assembled into a tube-like tunnel such that transverse and longitudinal joints are formed. Each segment has a recess which runs around all bearing surfaces and has two outer side faces and a base side. A rod-shaped sealing element is positioned in the recess. According to the invention the recess within the central area of its base side has a support for the shaped sealing element such that two parallel recesses are formed. Each recess has an outer side face, an inner side face and a base side and a shaped body is housed in each recess. These two shaped bodies are joined to each other by means of a shaped body situated above the support.

10 Claims, 3 Drawing Sheets

SEALING DEVICE

CROSS REFERENCE TO RELATED APPLICATIONS

Applicant claims priority under 35 U.S.C. §119 of German Application No. 198 30 376.9 filed Jul. 8, 1998. Applicant also claims priority under 35 U.S.C. §120 of PCT/DE99/02132 filed Jun. 24, 1999. The international application under PCT article 21(2) was not published in English.

DESCRIPTION

The invention relates to a sealing device consisting of two contiguous construction elements made of concrete, steel reinforced concrete, cast iron or other materials (for example synthetic resins), as well as a shaped sealing element made of an elastomer material (i.e. rubber or a material similar to rubber), which is inserted into a recess and bridges the gab between the construction elements in a sealing manner;

whereby the construction elements are in particular segments that are assembled to form a tube-like tunnel in such a way that transverse and longitudinal joints are formed, whereby each segment is provided with a recess extending all around the joined sides of the segment, and comprising two outer flanks and a base side, specifically in conjunction with the formation of a sealing frame with frame corners, whereby the shaped sealing element is provided with open and/or closed fluted grooves extending in the form of a strand, said fluted grooves being arranged on the base side of the section, as well as with channels also extending in the form of strands, said channels being arranged between the fluted grooves and the face side of the section.

A sealing device of the type specified above is known, for example from U.S. Pat. No. 4,946,309. Due to the fact that the construction elements or segments joining one another are compressed in conjunction with a reduction of the spacing of the gap or the transverse and longitudinal joints, the sealing section made of elastomer material unfolds its sealing effect as a result of the interaction occurring between the force and the reactive force. Such compression sealing devices have been successfully employed in connection with numerous tunnel projects.

Now, based on the prior art described above, the problem of the invention is to provide a sealing device that is suitable for a permanent sealing effect in particular in the presence of major displacements of the construction elements or segments joined with each other.

Now, said problem is solved in that the recess has within the center zone of its base side a support for the shaped sealing element that extends in the direction of the jointed side and also extends in the form of a strand, specifically in conjunction with the formation of two recesses that extend parallel with each other, whereby each recess comprises an outer flank, an inner flank and a base side, and whereby, furthermore, a shaped body is located in each recess, whereby said two shaped bodies in turn are connected with each other by means of a shaped body located above the support, said shaped body having a different geometry as compared to the one of the other two shaped bodies, namely with respect to the direction of the strand over the entire length of the shaped body.

The useful embodiments of the sealing device as defined by the invention are described as follows:

The two recesses extending parallel with each other are arranged mirror-symmetrically.

The face side of the support is situated lower than the joined side of the construction element or segment, namely in conjunction with the formation of a recess on the face side.

The two shaped bodies located in the parallel extending recesses are identical with respect to their geometry, whereby, furthermore, a total of three shaped bodies form a one-piece overall composite, specifically preferably in conjunction with the formation of a common plane face side of the shaped sealing element.

It is advantageous, furthermore, if a fluted groove and/or two fluted grooves are present within the three shaped bodies.

The outer and inner flanks of the two parallel extending recesses extend in a slanted way, specifically in conjunction with a widening of the two recesses toward the joint side of the construction element or segment.

The cross sectional area of the support is smaller than the cross sectional area of the entire recess, the latter being formed by the two parallel a extending recesses as well as, if need be, the recess on the face side. In particular, the cross sectional area of the support is again smaller than the cross section area of each of the two parallel extending recesses.

The support completely extends around the construction element or segment.

All constructional design features of the sealing device mentioned herein within the framework of the claims are related to the relieved condition of the device.

The invention is now explained with the help of exemplified embodiments and by reference to schematic drawings, in which.

Figure 1:
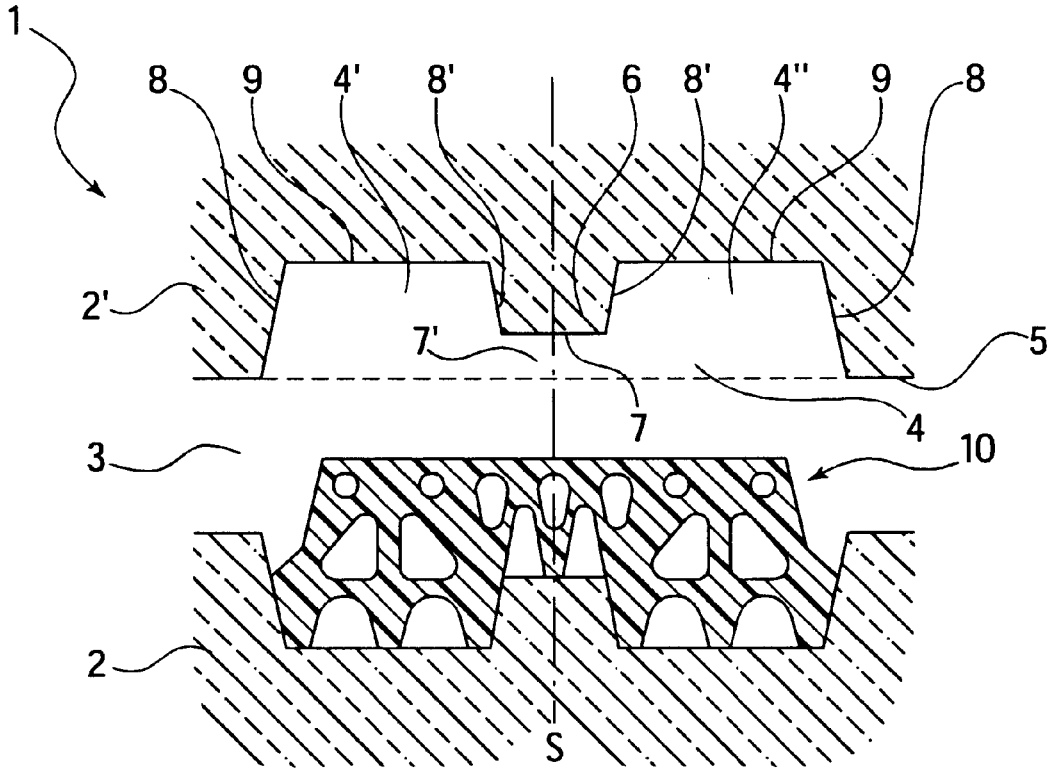
FIG. 1 shows a sealing device comprising two tunnel segments joined with one another, as well as a shaped sealing element in which the recess as defined by the invention is located.

The following list of reference numerals and symbols applies to said figures:

1 Sealing device
2, 2' Segments of tunnel tubes
3 Gap (transverse or longitudinal joint)
4, 4', 4" Recess in segment
5 Joint side of segment
6, 6', 6" Support
7 Face side of support
7' Face side of recess
8 Outer flank of recess
8' Inner flank of recess
9 Base side of recess
10, 10', 10" Shaped sealing element made of elastomer material (glued in or anchored according to DE-A-39 34 198)
11, 11', 11" Plane face side of shaped element
12, 12', 12" Fluted groove of shaped sealing element within the zone of the base side of the recess
13,13', 13" Fluted groove of the shaped sealing element within the zone of the support
14, 14', 14" Channel of the shaped sealing element A Shaped sealing body within the recess
B Shaped sealing body within the support
S Mirror plane FIG. 1 shows a sealing device 1 with the two segments 2 and 2' abutting each other. Each segment is provided with a recess 4. Within the center zone of its base side 9, the recess has a support 6 extending in the direction of the joint side 5 of the segment, forming the two parallel extending recesses 4' and 4", which, furthermore, are arranged mirror-symmetrically in relation to each other specifically with respect to the mirror plane S.

The face side 7 of the support 6 is located lower than the joint side 5 of the segments 2 and 2', specifically with the formation of a face-side recess 7'. The entire recess 4 with respect to the dotted line (line of continuation of the joint side 5 of the segment) comprises the two outer flanks 8, the two inner flanks 8', the two base sides 9 as well as the face side 7. The outer and inner flanks each extend in this connection in an inclined manner, specifically in conjunction with a widening of the two recesses 4' and 4" toward the joint side 5 of the segment.

The cross sectional area of the support 6 is smaller than the cross sectional area of the entire recess 4 formed by the two parallel extending recesses 4' and 4" as well as by the recess 7' on the face side. Furthermore, the cross sectional area 6 is smaller than the cross sectional area of each of the two parallel extending recesses 4' and 4'".

The support 6 extending in the form of a strand completely extends around the segments 2 and 2', respectively. Therefore, the support is present also in the corner zone.

In connection with a recess according to the prior art, the two base sides 9 are joined with each other all the way through without the support 6.

Now, a shaped sealing element 10 is situated in the recess 4 of each segment, said shaped sealing element bridging the gap between the segments 2 and 2' in a sealing manner.

Figure 2:
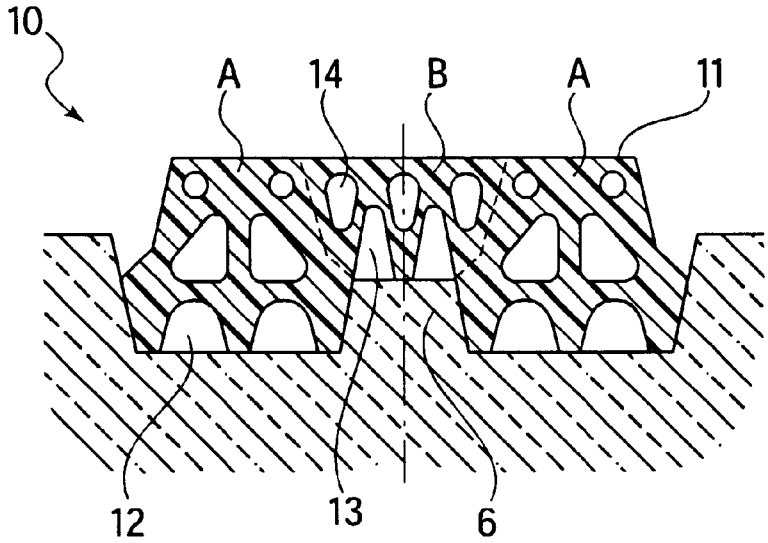
FIG. 2 shows design details of the shaped sealing element according to FIG. 1.
Figure 1A:
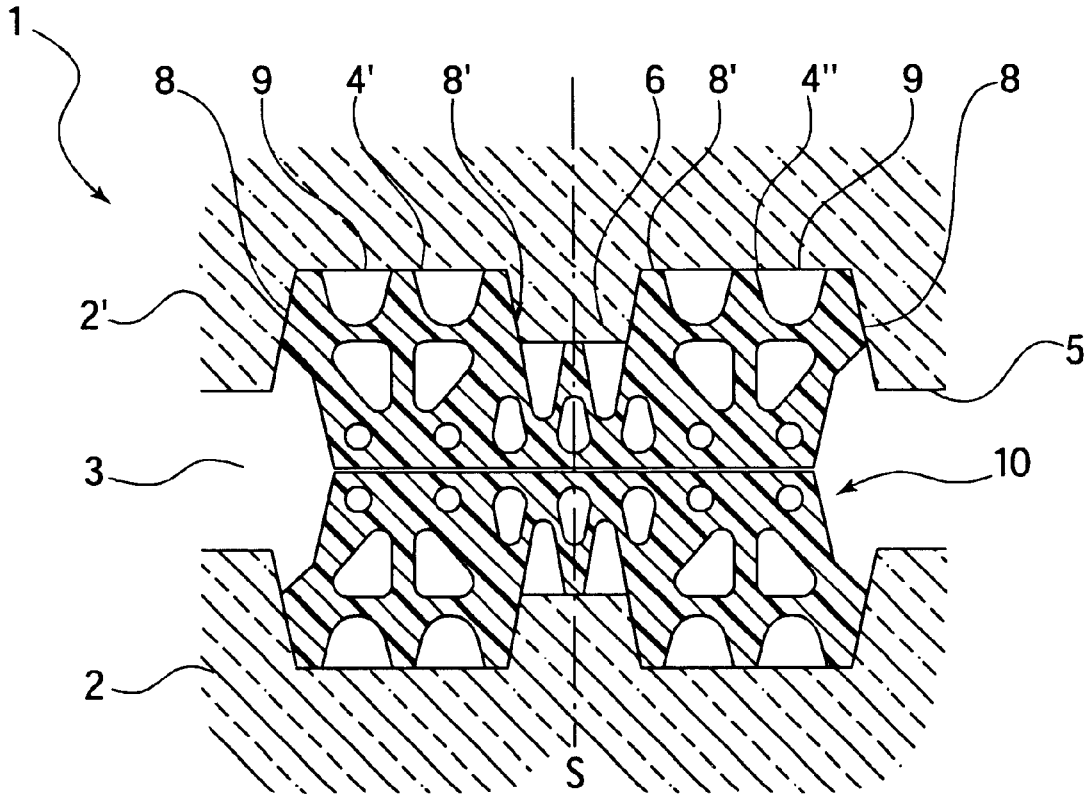
FIG. 1A shows the sealing device of FIG. 1 in an assembly conditioned.

Now, FIG. 2 shows details of the construction of the shaped sealing element 10. A shaped body "A" is situated in each of the two parallel extending recesses 4' and 4" (FIG. 1), said shaped bodies being identical with respect to their geometry. Said two shaped bodies are in turn connected with each other by means of a shaped body "B" that is located above the support 6, said shaped body having a geometry that is different as compared to the one of the two other shaped bodies "A". Said two shaped bodies are connected with each other over the entire length of the shaped segment specifically with respect to the direction of the strand.

The three shaped bodies "A" and "B" are a one-piece overall composite specifically in conjunction with the formation of a common plane face side 11 of the shaped element. Said three shaped bodies each are provided with the two fluted grooves 12 and 13. Furthermore, said shaped bodies are additionally provided with the channels 14.

Figure 3:
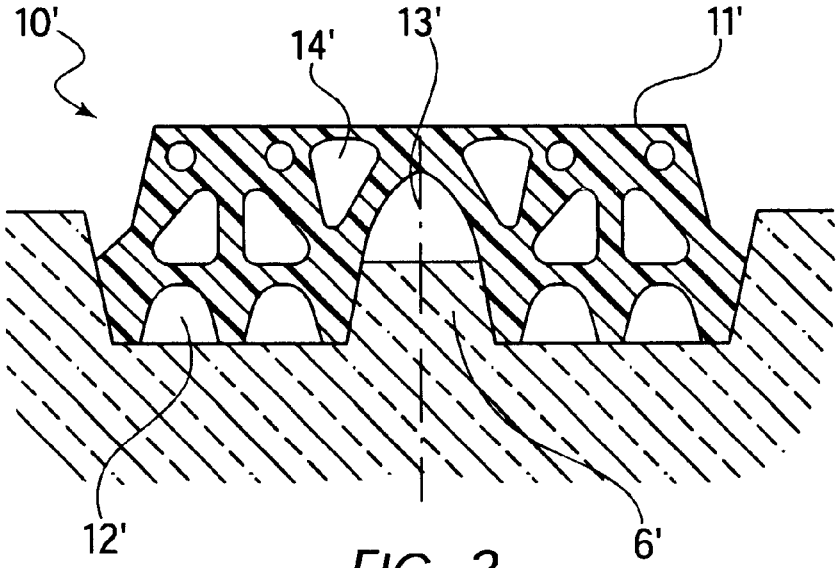
FIGS. 3 and 4 show further exemplified embodiments of shaped sealing elements.
Figure 4:
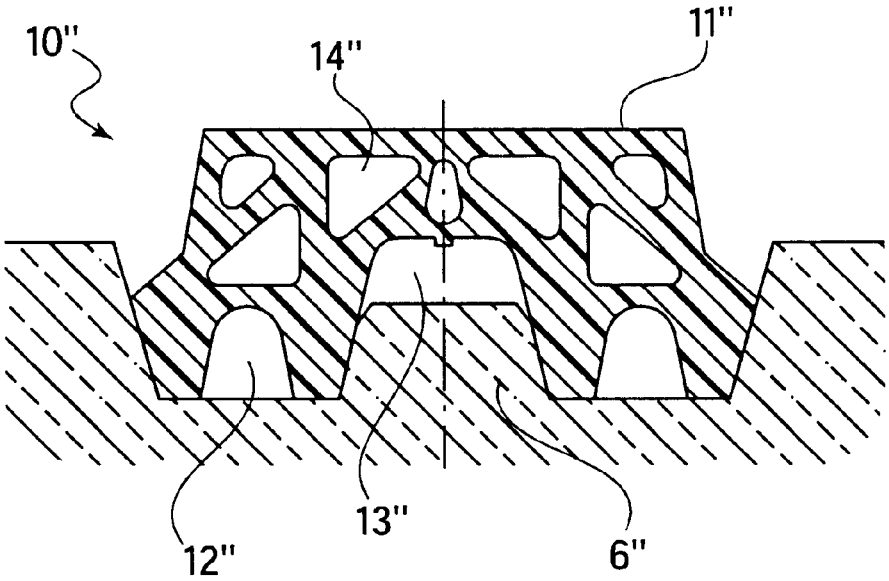

FIGS. 3 and 4 show the shaped sealing elements 10' and 10", respectively, where in each case only one fluted groove 13' and 13", respectively, is present within the zone of the supports 6' and, respectively, 6".

What is claimed is:

1. A sealing device comprising:

two contiguous construction elements made from a material selected from the group consisting of concrete, steel, reinforced concrete and cast iron, each element having a recess, two shaped sealing elements made of elastomer material inserted one into each recess of said construction elements, each shaped sealing element being shaped in the form of a strand and bridging a gap between the construction elements in a sealing manner, each sealing element forming a sealing frame with corners, wherein the shaped sealing element has fluted grooves, said grooves being arranged on a base side of the shaped element, and wherein the shaped sealing element also has channels extending between the fluted grooves and a face side of the shaped element;

wherein each construction element comprises segments assembled to a tube-like tunnel with formation of transverse and longitudinal joints, each one of said segments having a recess comprising segment joint sides and comprising two outer flanks and a base side;

wherein the recess has within a center zone of its base side a support for the shaped sealing element, said support extending in the form of a strand in a direction of the joint side and forming two parallel extending recesses, each parallel extending recess comprising an outer flank, an inner flank and a base side, wherein the sealing element comprises a first shaped body situated in each parallel extending recess, said shaped bodies being connected with each other by a second shaped body situated above the support, said second shaped body having a different geometry as compared to said first shaped bodies.

2. The sealing device according to claim 1, wherein the two parallel extending recesses are arranged mirror-symmetrically in relation to each other.

3. The sealing device according to claim 1, wherein a face side of the support is disposed lower than a joint side of the construction element, and has a recess on the face side.

4. The sealing device according to claim 1, wherein said first shaped bodies have identical geometries.

5. The sealing device according to claim 1, wherein all of said shaped bodies form a one-piece overall composite.

6. The sealing device according to claim 1, wherein at least one fluted groove is present within all of the shaped bodies.

7. The sealing device according to claim 1, wherein all of the shaped bodies form a common plane face side of the shaped sealing element.

8. The sealing 0device according to claim 1, wherein the outer flanks and the inner flanks of the two parallel extending recesses each extend in an inclined manner in conjunction with a widening of the two parallel extending recesses towards a joint side of the construction element.

9. The sealing device according to claim 1, wherein a cross sectional area of the support is smaller than a cross sectional area of the entire recess of the construction element, said recess being formed by the two parallel extending recesses and by the recess on the face side.

10. The sealing device according to claim 9, wherein the cross sectional area of the support is smaller than the cross sectional area of each of the two parallel extending recesses.

* * * * *